US009273915B2

(12) United States Patent
Patel

(10) Patent No.: US 9,273,915 B2
(45) Date of Patent: Mar. 1, 2016

(54) ENHANCED CAPACITY, REDUCED TURBULENCE, TROUGH-TYPE LIQUID COLLECTOR TRAYS

(75) Inventor: Kantilal P. Patel, Sugar Land, TX (US)

(73) Assignee: Amistco Seperation Products, Inc., Houston, TX (US)

( * ) Notice: Subject to any disclaimer, the term of this patent is extended or adjusted under 35 U.S.C. 154(b) by 872 days.

(21) Appl. No.: 13/383,882

(22) PCT Filed: Jul. 16, 2010

(86) PCT No.: PCT/US2010/042270

§ 371 (c)(1), (2), (4) Date: Jan. 13, 2012

(87) PCT Pub. No.: WO2011/009048

PCT Pub. Date: Jan. 20, 2011

(65) Prior Publication Data

US 2012/0111762 A1 May 10, 2012

Related U.S. Application Data

(60) Provisional application No. 61/226,315, filed on Jul. 17, 2009.

(51) Int. Cl.
*B01F 3/04* (2006.01)
*F28F 25/02* (2006.01)

(52) U.S. Cl.
CPC ..... *F28F 25/02* (2013.01)

(58) Field of Classification Search
CPC ..... F28F 25/02
USPC ..... 261/97, 108, 110, 112.2, 114.1, 114.3, 261/114.4, 114.5, DIG. 85; 95/216, 221, 95/267, 272; 96/189, 190, 356, 358
See application file for complete search history.

(56) References Cited

U.S. PATENT DOCUMENTS

| | | | | |
|---|---|---|---|---|
| 2,606,750 | A | 8/1952 | Jacir | |
| 3,290,024 | A | 12/1966 | Huber | |
| 3,290,867 | A | 12/1966 | Jacir | |
| 4,175,938 | A * | 11/1979 | Regehr et al. | 55/440 |

(Continued)

OTHER PUBLICATIONS

International Search Report in corresponding International Application No. PCT/US2010/042270 issued Sep. 7, 2010 (1 page).

(Continued)

*Primary Examiner* — Charles Bushey
(74) *Attorney, Agent, or Firm* — Osha Liang LLP; John W. Montgomery

(57) ABSTRACT

Liquid collector trays (5) are disclosed for use in vertical towers (7) in which vapor (9) moves upward and liquid (11) moves downward. The liquid collector trays (5) employ elongated plates (13) which in certain embodiments include a primary liquid collector trough (15) and a secondary liquid collector trough (17). In other embodiments, the primary liquid collector troughs (15) of adjacent plates (13) are aligned so as to form elongated, inwardly-tapering entrance channels (29) which are free of sharp corners. In further embodiments, when the liquid collector tray (5) is in its operative orientation and is viewed from above, each plate (13) includes first and second concave surfaces (31, 33), which collect liquid, and third and fourth convex surfaces (35, 37), which are adjacent to the first and second concave surfaces (31, 33) and serve to mechanically stabilize the plate (13).

4 Claims, 5 Drawing Sheets

(56) References Cited

U.S. PATENT DOCUMENTS

| | | | | | |
|---|---|---|---|---|---|
| 4,198,215 | A | * | 4/1980 | Regehr | 55/440 |
| 4,215,080 | A | | 7/1980 | Ribier et al. | |
| 4,218,408 | A | * | 8/1980 | Henning et al. | 261/112.2 |
| 4,416,835 | A | * | 11/1983 | Bosne | 261/110 |
| 4,521,350 | A | * | 6/1985 | Lefevre | 261/111 |
| 4,744,929 | A | * | 5/1988 | Robinson et al. | 261/97 |
| 5,268,011 | A | * | 12/1993 | Wurz | 55/440 |
| 5,318,732 | A | * | 6/1994 | Monkelbaan et al. | 261/114.1 |
| 5,413,872 | A | * | 5/1995 | Faigle | 428/603 |
| 5,464,573 | A | | 11/1995 | Tokerud et al. | |
| 6,527,258 | B2 | | 3/2003 | Bartlok | |
| 7,114,709 | B2 | | 10/2006 | Ender et al. | |
| 7,947,123 | B2 | * | 5/2011 | Kwok et al. | 95/267 |
| 8,083,901 | B2 | * | 12/2011 | Sharma et al. | 202/158 |
| 8,105,022 | B2 | * | 1/2012 | Ewida et al. | 415/169.2 |

OTHER PUBLICATIONS

Written Opinion in corresponding International Application No. PCT/US2010/042270 issued on Sep. 7, 2010 (6 pages).

International Preliminary Report on Patentability in corresponding International Application No. PCT/US2010/042270 mailed Jan. 17, 2012 (7 pages).

* cited by examiner

PRIOR ART

ENHANCED CAPACITY, REDUCED TURBULENCE, TROUGH-TYPE LIQUID COLLECTOR TRAYS

CROSS-REFERENCE TO RELATED APPLICATION

This application claims the benefit under 35 USC §119(e) of U.S. Provisional Application No. 61/226,315 filed on Jul. 17, 2009, the contents of which in its entirety is hereby incorporated by reference.

FIELD

This disclosure relates to trough-type liquid collector trays for use in vertical towers in which vapor moves upward and liquid moves downward.

BACKGROUND

Liquid collectors (also known as chimney trays and collector trays) are used in vertical vapor-liquid contact towers designed for countercurrent vapor-liquid flow where the vapor (gas) flows upward and the liquid flows downward. In these towers, various processes require the liquid to be collected and redirected to another section of the tower and/or withdrawn from the tower.

There are generally two types of liquid collector trays that have been developed in the art. The first type uses a sheet-metal floor which occupies the cross-section of the tower at an appropriate location, with round pipe risers or rectangular box risers being used for the upward passage of vapor. The liquid dripping from structures above the tray is collected on the tray's floor and then withdrawn from the side of the tower through, for example, a nozzle. Rather than being withdrawn from the tower, all or some of the liquid may be diverted to another device such as liquid distributor within the same tower immediately below the collector tray. This type of collector tray may be secured in the tower by bolting or welding to a support ring. If a bolted construction is used, an appropriate gasket is employed to make the operation leak tight.

The second type of liquid collector tray employs a series of parallel troughs and thus is known as a "trough-type liquid collector tray." Trays of this type are also known as "vane type" or "lamella type" trays. The present disclosure is concerned with trays of this type.

FIGS. 8 and 9 are cross-sectional views of a typical trough structure as currently used in the art. Liquid 11 dripping from devices above the tray enters the collector through the space between two adjacent angular lamellae 71 and is collected in the troughs 73 at the bottoms of the lamellae. Vapor 9 rises along the angular sides of the lamellae 71 and finally discharges from the top of the collector.

Compared to the riser-type collector trays, trough-type trays provide substantially greater open areas. For example, a typical collector tray with risers provides an open area equal to 10% to 30% of the cross section area of the tower at the bottom where the vapor enters. For a typical trough-type collector tray, on the other hand, this area can be as much as 60% of the tower cross section area. Therefore, trough-type trays are much more suitable for an atmospheric tower and even more desirable for a vacuum tower as these devices offer lower pressure drops.

Existing trough-type collector trays have, however, suffered from a number of drawbacks. In particular, the trays have had vapor paths, including vapor entrances and vapor exits, that include sharp corners (see FIGS. 8 and 9), which reduce vapor flow and thus lead to additional head losses (pressure drops). Also, the liquid-holding capacity of the trays has been limited by their structure. The present disclosure is directed to trough-type collector trays which address these longstanding deficits in the art.

SUMMARY

In accordance with a first aspect, a liquid collector tray (5) is disclosed for use in a vertical tower (7) in which vapor (9) moves upward and liquid (11) moves downward, the liquid collector tray (5) including a plurality of elongated plates (13), each plate (13) including:

(a) a primary liquid collector trough (15);
(b) a secondary liquid collector trough (17); and
(c) a wall (19) located between the primary liquid collector trough (15) and the secondary liquid collector trough (17);

wherein when the liquid collector tray (5) is in its operative orientation:

(i) the primary liquid collector troughs (15) are below the secondary liquid collector troughs (17); and
(ii) for each elongated plate (13), the primary liquid collector trough (15) is horizontally offset from the secondary liquid collector trough (17).

In accordance with a second aspect, a liquid collector tray (5) is disclosed for use in a vertical tower (7) in which vapor (9) moves upward and liquid (11) moves downward, the liquid collector tray (5) including a plurality of adjacent elongated plates (13), each plate (13) including a primary liquid collector trough (15) having a wall that includes:

(a) a first outwardly-sloped segment (23),
(b) a second outwardly-sloped segment (25), and
(c) a rounded bottom segment (27) which connects the first (23) and second (25) outwardly-sloped segments;

wherein for at least two of the adjacent elongated plates (13), the first outwardly-sloped segment (23) of one of the plates (13) is aligned with the second outwardly-sloped segment (25) of the other of the plates (13) so as to form an elongated, inwardly-tapering entrance channel (29) for vapor (9) passing upward between the two plates (13), the entrance channel (29) being free of sharp corners.

In accordance with a third aspect, a liquid collector tray (5) is disclosed for use in a vertical tower (7) in which vapor (9) moves upward and liquid (11) moves downward, the liquid collector tray (5) comprising a plurality of adjacent elongated plates (13), wherein when the liquid collector tray (5) is in its operative orientation and is viewed from above, each plate (13) comprises:

(a) first (31) and second (33) surfaces for collecting liquid (11), the surfaces (31, 33) each having an overall concave shape; and
(b) third (35) and fourth (37) surfaces for mechanically stabilizing the plate (13), the surfaces (35, 37) each having an overall convex shape, the third surface (35) being adjacent the first surface (31) and the fourth surface (37) being adjacent the second surface (33).

The reference numbers used in the above summaries of the various aspects of the disclosure are only for the convenience of the reader and are not intended to and should not be interpreted as limiting the scope of the invention. More generally, it is to be understood that both the foregoing general description and the following detailed description are merely exemplary of the invention and are intended to provide an overview or framework for understanding the nature and character of the invention.

Additional features and advantages of the invention are set forth in the detailed description which follows, and in part will be readily apparent to those skilled in the art from that description or recognized by practicing the invention as described herein. The accompanying drawings are included to provide a further understanding of the invention, and are incorporated in and constitute a part of this specification. It is to be understood that the various features of the invention disclosed in this specification and in the drawings can be used in any and all combinations.

DETAILED DESCRIPTION

As discussed above, the present disclosure pertains to liquid collection in countercurrent vapor-liquid contact towers in which liquid is collected from a section of the tower and subsequently withdrawn from and/or redirected in the tower. More particularly, the present disclosure relates to liquid collection in which the liquid is collected in multiple troughs arranged in parallel.

Figure 1:
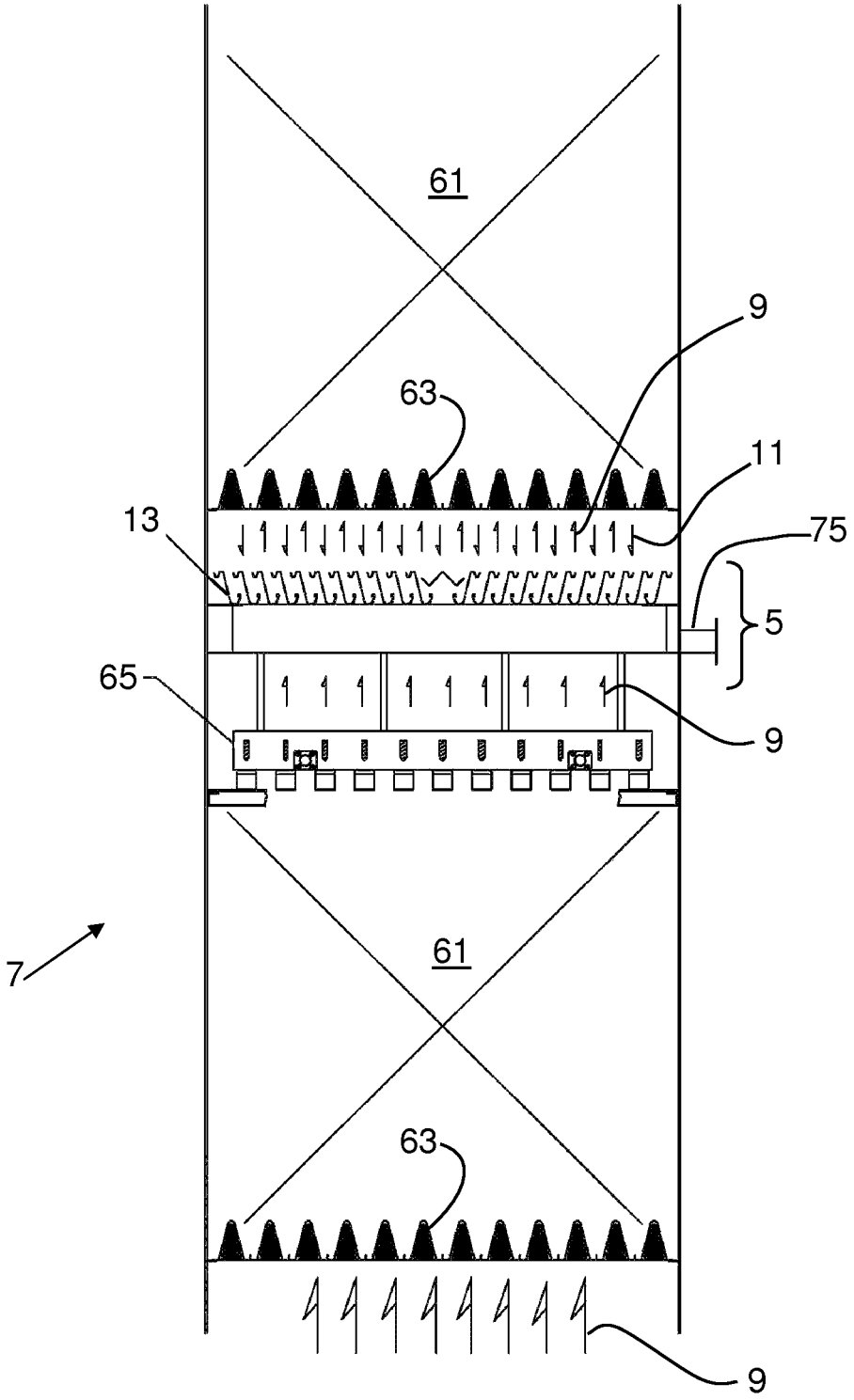
FIG. 1 is a schematic cross-sectional view showing a liquid collector tray according to the present disclosure, the tray being installed in a representative vertical tower through which vapor moves upward and liquid moves downward.
Figure 2:
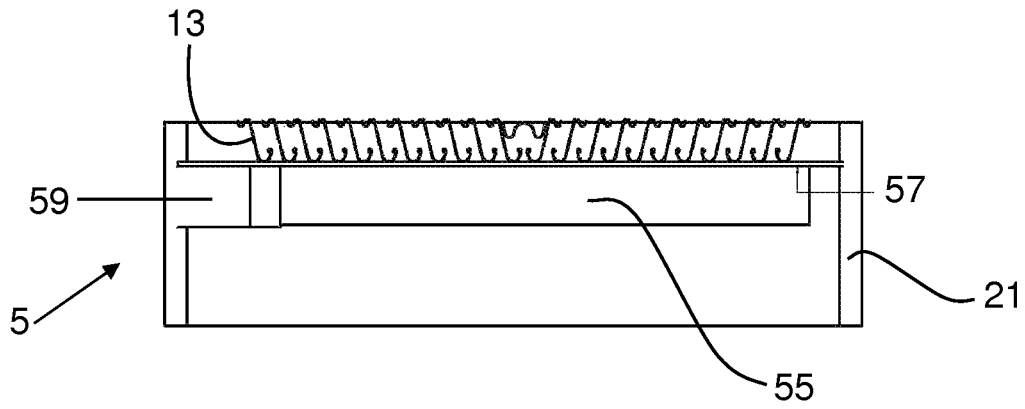
FIG. 2 is an elevation view of the liquid collector tray of FIG. 1.
Figure 3:
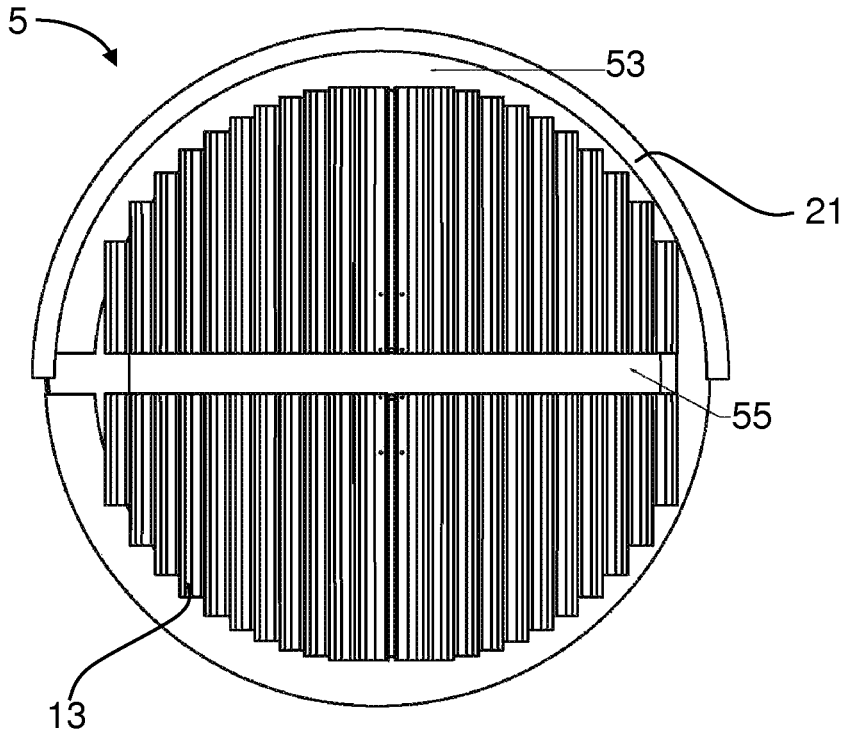
FIG. 3 is a plan view of the liquid collector tray of FIG. 1.
Figure 4:
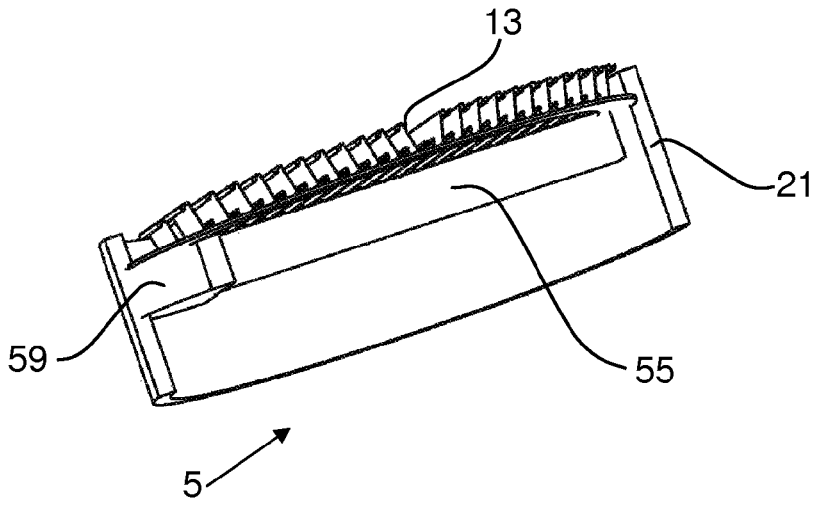
FIG. 4 is an isometric view from the side of the liquid collector tray of FIG. 1.
Figure 5:
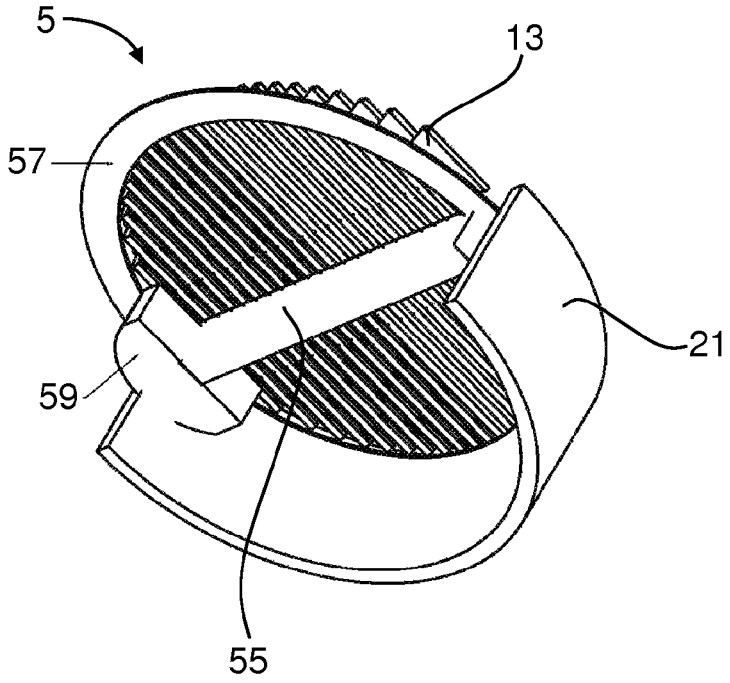
FIG. 5 is an isometric view from below of the liquid collector tray of FIG. 1.

FIG. 1 shows a tower 7 having installed therein a trough-type liquid collector tray 5 constructed in accordance with the principles of the present disclosure. As shown in FIG. 1, in addition to liquid collector tray 5, tower 7 can include packings 61 supported by packing supports 63 and a liquid distributor 65 for distributing liquid collected from the upper packing over the surface of the lower packing. The tower shown in FIG. 1 is, of course, only representative of the types of towers with which the trays of the present disclosure can be used. As will be recognized by persons skilled in the art, the tower can have a variety of configurations and constructions, including square, round, or other shaped cross-sections, more or less packings than shown in FIG. 1, more collector trays than shown, more or less distributors, and the like. Also, although it is preferred that all collector trays used in the tower are constructed in accordance with the present disclosure, in some cases, it may be desirable to use a collector tray of the present disclosure in combination with other types of collector trays for specific applications.

FIGS. 2-5 show an embodiment of a representative collector tray of the present disclosure in more detail. As can be seen, tray 5 includes an outer frame 21 for use in mounting the tray inside the tower by, for example, bolting or welding. For a bolted construction, a gasket will normally be used to avoid leakage between the tray and the tower's wall. Liquid is collected by elongated plates 13, discussed in detail below. The plates 13 are affixed to outer ring 57, e.g., by welding in the case of metal plates or bolting to the ring. The plates are sloped so as to empty their contents into annular collection sump 53 or center collection sump 55, either or both of which can be used to provide further support for the plates 13. The annular collection sump can, for example, be created by welding a rolled angle to the tower wall. Sumps 53 and 55 are each sloped so that their contents flow into side sump 59 from which the collected liquid is, for example, provided to a distributor (e.g., distributor 65 in FIG. 1) and/or removed from the tower (e.g., using port 75 in FIG. 1).

Figure 6:
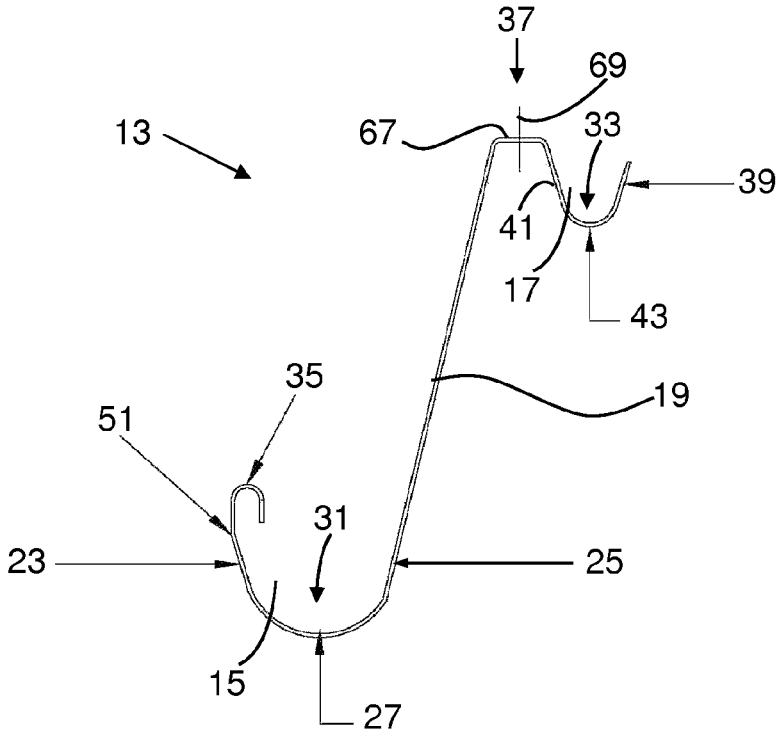
FIG. 6 is a cross-sectional view of an individual plate of the liquid collector tray of FIG. 1.
Figure 7:
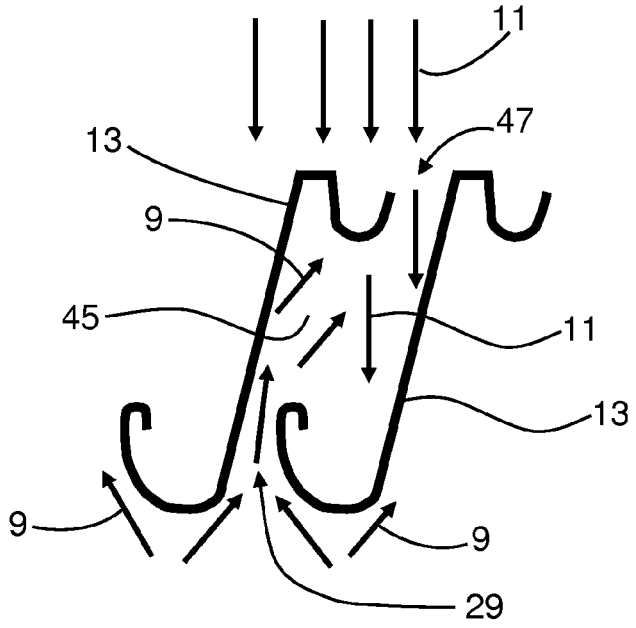
FIG. 7 is a cross-sectional view illustrating an arrangement for two adjacent plates of the liquid collector tray of FIG. 1.

FIGS. 6 and 7 show the construction and operation of elongated plates 13 in more detail. The plates, which can also be referred to as lamellae, can be made of a variety of materials including plastics and metals. In the case of plastics, the plates can be made by any plastic forming method, e.g., extrusion, molding, fusing, or forming. In the case of metals, the plates are preferably made by forming a single strip of a formable metal, e.g., stainless steel, into the desired shaped. Typically, when made from metal, the plates will have a thickness in the range of 0.060-0.135 inches, e.g., about 0.075 inches.

As shown in FIG. 6, in certain embodiments, plate 13 includes a primary liquid collector trough 15, a secondary liquid collector trough 17 which is horizontally offset from the primary liquid collector trough, and a wall 19 located between the primary and secondary troughs. Wall 19 will typically be slanted as shown in FIGS. 6 and 7, but can be vertical, if desired. When slanted, the deviation from vertical is preferably less than or equal to about 30°.

Secondary collector trough 17 provides enhanced capacity for each of plates 13 and thus for the entire liquid collector tray. Typically, the secondary collector trough will have a cross-sectional area that is less than the cross-sectional area of the primary liquid collector trough, although the cross-sectional areas can be equal or the secondary trough can have a larger cross-sectional area if desired.

As shown in FIG. 7, when the liquid collector tray is in its operative orientation, the primary liquid collector troughs are below the secondary liquid collector troughs. Also, for the FIG. 7 embodiment, the entirety of the plate's secondary liquid collector trough is vertically above the primary liquid collector trough of an adjacent plate (except for end plates; see FIGS. 1-5). Alternatively, in other embodiments, only a part of the plate's secondary liquid collector trough is vertically above the primary liquid collector trough of an adjacent plate. It should be noted that, if desired, the vertically overlapping portions of the troughs can be quite small. For example, to prevent liquid from passing downward through the tray without being caught by any of the troughs, the outer edge of the secondary trough of one plate only needs to be located directly above the outer edge of the primary trough of an adjacent plate.

Figure 9:
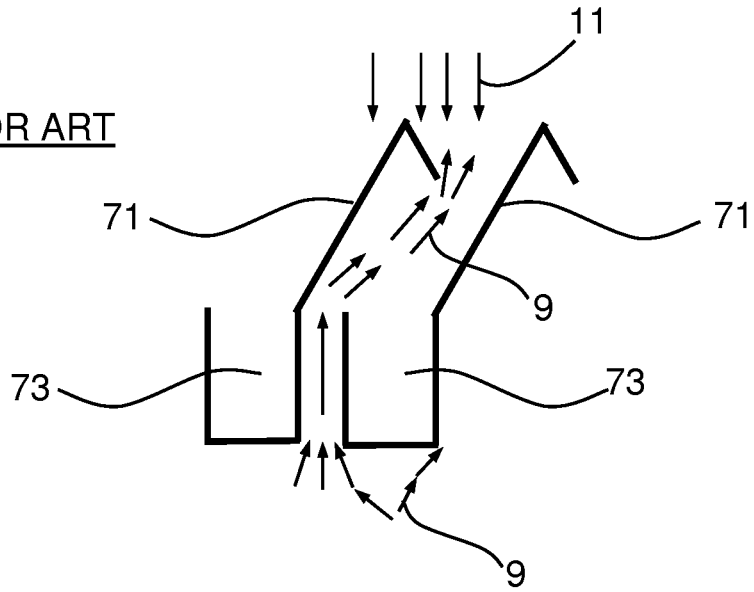
FIG. 9 is a cross-sectional view illustrating a prior art arrangement for two adjacent lamellae.

FIG. 7 also illustrates an arrangement and structure for plates 13 that reduces the turbulence of vapor 9 passing through the liquid collector tray. As discussed above and illustrated in FIG. 9, in the prior art, upward flowing gas encountered many sharp corners and abrupt changes in direction which tended to produce regions of turbulent flow. This turbulence, in turn, is believed to have resulted in unnecessarily high losses in head pressure. In accordance with an embodiment of the present disclosure, such unnecessary turbulence is reduced by providing flow paths for vapor which are free of sharp corners which contact, e.g., point into, the flow path.

In FIG. 7, the flow path for vapor includes an entrance channel 29, an internal chamber 45, and an exit channel 47. As can be seen in FIG. 7, the surfaces which the vapor contacts as it passes into the entrance channel 29, through the internal chamber 45, and out of the exit channel 47, are free of sharp corners which contact the flow path. In contrast, in the prior art structure of FIG. 9, the vapor path repeatedly contacts sharp corners capable of producing turbulent flow. It should be noted that the surfaces which contact the vapor do not have to be perfectly smooth or perfectly rounded, but can include slight bends such as those produced, for example, when forming a metal sheet into a plate. For example, such bends in vapor-contacting surfaces can occur at transitions between rounded sections of metal and flat sections of metal. However, the vapor-contacting surfaces need to be free of corners of the type shown in FIG. 9, which can interrupt the vapor flow and transform smooth flow into turbulent flow.

As shown in FIG. 7, in certain embodiments, entrance channel 29 has an inwardly-tapered structure to guide vapor 9 into internal chamber 45. As best shown in FIG. 6, such an entrance channel can be produced by providing the wall of the primary liquid collector 15 with three segments: (a) a first outwardly-sloped segment 23, (b) a second outwardly-sloped segment 25, and (c) a rounded bottom segment 27 which connects the first and second outwardly-sloped segments. The inwardly-tapered entrance channel is then automatically formed by simply aligning the first outwardly-sloped segment 23 of one of the plates with the second outwardly-sloped segment 25 of an adjacent plate. By merging the segments with at most shallow bends, the entrance channel formed in this way is free of sharp corners.

For this construction, wall 19 can be a continuation at the same slope of the second outwardly-sloped segment 25 of the wall of the primary liquid collector trough. Alignment of two adjacent plates to form entrance channel 29 then automatically forms internal chamber 45, which smoothly receives vapor exiting the entrance channel and gradually changes the vapor's direction of flow so that it points towards exit channel 47. As with the entrance channel, the surfaces of internal chamber 45 which contact flowing vapor during use of the liquid collector tray are free of sharp corners which contact (point into) the flowing vapor.

To smooth the transition between the entrance channel and the internal chamber, the first outwardly-sloped segment 23 of the primary liquid collector trough can include an edge portion where the plate bends back upon itself towards the second outwardly-sloped segment 25 so as to produce a smooth (rounded) surface at the exit of the entrance channel. This edge portion can begin at, for example, inward bend 51 shown in FIG. 6. By means of the smooth curve provided by the edge portion, the turbulence and associated pressure drop arising from the vapor acquiring an angular flow direction in internal chamber 45 can be reduced:

In certain embodiments, exit channel 47 is formed by providing the wall of the secondary liquid collector 17 with three segments: (a) a first outwardly-sloped segment 39, (b) a second outwardly-sloped segment 41, and (c) a rounded bottom segment 43 which connects the first and second outwardly-sloped segments. Exit channel 47, which is free of sharp corners which contact (point into) the vapor flow path, is then automatically formed by simply aligning the first outwardly-sloped segment 39 of the secondary liquid collector trough of one of the plates with the slanted wall 19 of an adjacent plate. In a typical embodiment, the slopes of segment 39 and wall 19 will be substantially the same so that the exit channel has substantially parallel internal walls. It should be noted that although the uppermost edge of first outwardly-sloped segment 39 of the secondary collector trough can be sharp, this edge points along, rather than into, the vapor stream and thus does not generate turbulence (compare the edge of plate 71 in FIG. 9 which points into the vapor stream and thus generates turbulence and backpressure).

Figure 8:
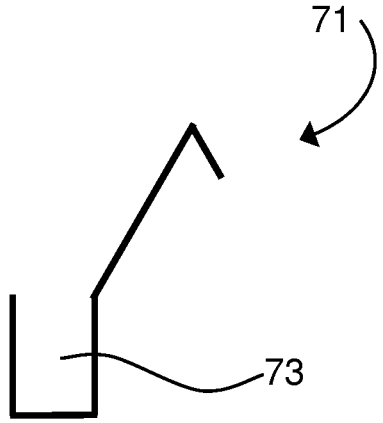
FIG. 8 PRIOR ART
FIG. 8 is a cross-sectional view of a prior art lamella.

As best shown in FIG. 6, plate 13 can include a mechanical stabilizer 67 between wall 19 and secondary liquid collector trough 17. This stabilizer can include a stabilization rib 69 running along its length. More generally, the use of rounded surfaces can tend to reduce the mechanical stability of plates 13 compared to the prior art structures of FIGS. 8-9, which included sharp corners which resist mechanical flexure. Accordingly, in certain embodiments, convex and concave surfaces are paired to increase the overall mechanical stability of the plate, e.g., to reduce the tendency of plates to vibrate as vapor moves upward through the tray. Thus, when in its operative orientation and viewed from above, each plate 13 can include: (a) first and second surfaces (31, 33), which have an overall concave shape and serve to collect liquid; and (b) third and fourth surfaces (35, 37), which have an overall convex shape, are adjacent to the first and second surfaces, respectively, and serve to mechanically stabilize the plate.

In operation, a liquid collector tray 5 having plates of the type shown in FIGS. 6-7 collects liquid dripping downward in troughs 15 and 17 and allows vapor (gas) to rise between the primary troughs along their angular sides, then between the slanted walls between adjacent plates, and finally to be discharged from the top of the collector between the angular side of a secondary trough and the slanted wall of an adjacent plate. The liquid dripping downward is either caught in secondary trough 17 or enters primary trough 15 through the space between two adjacent plates. Through its use of curved surfaces and aerodynamic shapes at its entrance side, internally at the vapor's first major change of direction, and at its exit side, the collector tray can reduce turbulence and thus reduce entrance and exit pressure losses. The smooth transition of the vapor through the collector also can result in less breakdown of liquid into fine droplets which may be entrained with the vapor exiting from the collector. In addition to these benefits, the provision of a secondary liquid collector provides additional liquid collection capacity. The enhanced liquid collection capacity means that for some applications, less plates can be used, thus reducing costs.

A variety of modifications that do not depart from the scope and spirit of the invention will be evident to persons of ordinary skill in the art from the foregoing disclosure. For example, although in FIGS. 1-5, all of plates 13 have the same configuration and a common inter-plate spacing, such uniformity is not required and in some applications, variations in the configuration and/or inter-plate spacing may be desirable, e.g., when the liquid flow from above is not expected to be uniform over the cross-sectional area of the tower. As other variations, although less preferred, the bottoms of the primary and secondary collector troughs can be flat and/or only one collector trough can be used, e.g., only a primary collector trough. The following claims are intended to cover these and other modifications and variations of the specific embodiments set forth herein.

What is claimed is:

1. A liquid collector tray for use in a vertical tower in which vapor moves upward and liquid moves downward, the liquid collector tray comprising a plurality of elongated plates arranged adjacent to each other, each elongated plate comprising:

(a) a primary liquid collector trough;

(b) a secondary liquid collector trough; and (c) a wall located between the primary liquid collector trough and the secondary liquid collector trough;

(d) a mechanical stabilizer located between the wall and the secondary liquid collector trough;

wherein when the liquid collector tray is in an operative orientation for the liquid collector tray:

(i) the primary liquid collector trough is vertically below the secondary liquid collector trough;

(ii) for each elongated plate, the primary liquid collector trough is horizontally offset from the secondary liquid collector trough (iii) the primary liquid collector trough having a concave surface viewed from above;

(iv) the secondary liquid collector trough having a concave surface viewed from above;

(v) the mechanical stabilizer having a convex surface viewed from above; and (e) wherein at least one of the elongated plates further comprises a mechanical stabilizer rib formed along the convex surface of the mechanical stabilizer located between the wall of the elongated plate and the secondary liquid collector trough of the elongated plate.

2. A liquid collector tray for use in a vertical tower in which vapor moves upward and liquid moves downward, the liquid collector tray comprising elongated plates, wherein when the liquid collector tray is in orientation for the liquid collector tray and is viewed from above, each plate comprises:

(a) first and second surfaces for collecting liquid, each having an overall concave shape;

(b) third and fourth surfaces for mechanically stabilizing the plate, each having an overall convex shape, the third surface being adjacent the first surface and the fourth surface being adjacent the second surface, to provide paired concave and convex surfaces for stability; and (c) further comprising a stabilizing rib affixed to the fourth surface.

3. The liquid collector tray of claim 2 wherein each plate is formed from a single strip of material.

4. The liquid collector tray of claim 3 wherein the single strip of material from which each plate is formed is composed of steel and has a thickness in the range of 0.060 to 0.135 inches that is bent into the first and third surfaces paired to provide overall concave and overall convex shaped surfaces and the second and fourth surfaces paired to provide overall concave and overall convex shaped surfaces.

* * * * *

UNITED STATES PATENT AND TRADEMARK OFFICE

CERTIFICATE OF CORRECTION

PATENT NO. : 9,273,915 B2
APPLICATION NO. : 13/383882
DATED : March 1, 2016
INVENTOR(S) : Kantilal P. Patel It is certified that error appears in the above-identified patent and that said Letters Patent is hereby corrected as shown below:

On the Title page:

At item 73, the Assignee is shown as "Amisto Seperation Products, Inc." and should read -- Amistco Separation Products, Inc. --

In the Claims:

At column 8, claim number 2, line number 1, "collector tray comprising elongated plates, wherein" should read -- collector tray comprising a plurality of adjacent elongated plates, wherein --

At column 8, claim number 2, line number 2, "liquid collector tray is in orientation for the liquid collector" should read -- liquid collector tray is in an operative orientation for the liquid collector --

Signed and Sealed this
Sixteenth Day of August, 2016

Michelle K. Lee

Michelle K. Lee
*Director of the United States Patent and Trademark Office*